US005389006A

United States Patent [19]

Noschese

[11] Patent Number: 5,389,006

[45] Date of Patent: Feb. 14, 1995

[54] LIGHTWEIGHT ENTERTAINMENT CONNECTOR

[75] Inventor: Rocco J. Noschese, Wilton, Conn.

[73] Assignee: Burndy Corporation, Norwalk, Conn.

[21] Appl. No.: 106,429

[22] Filed: Aug. 13, 1993

[51] Int. Cl.[6] ..... H01R 13/627

[52] U.S. Cl. ..... 439/354; 439/465

[58] Field of Search ..... 439/350, 351, 352, 353, 439/354, 355, 357, 358, 465, 466, 467, 677, 680, 681, 682, 610

[56] References Cited

U.S. PATENT DOCUMENTS

| | | | |
|---|---|---|---|
| 3,149,897 | 9/1964 | Martineck . | |
| 3,266,009 | 8/1966 | Jensen et al. | 439/352 |
| 3,409,859 | 11/1968 | Krehbiel . | |
| 3,569,900 | 3/1971 | Uberbacker . | |
| 3,569,903 | 3/1971 | Brishka . | |
| 4,002,389 | 1/1977 | Mammel | 439/350 |
| 4,421,376 | 12/1983 | Cosmos et al. . | |
| 4,602,838 | 7/1986 | Davis et al. . | |
| 4,641,902 | 2/1987 | Fuselman | 439/350 |
| 4,653,832 | 3/1987 | Sanchez | 439/465 |
| 4,682,828 | 7/1987 | Piper et al. | 439/92 |
| 4,715,827 | 12/1987 | Furman | 439/465 |
| 4,718,857 | 1/1988 | Noschese | 439/292 |
| 4,735,583 | 4/1988 | Rudy, Jr. et al. | 439/355 |
| 4,761,145 | 8/1988 | Goto et al. | 434/469 |
| 4,764,129 | 8/1988 | Jones et al. | 439/677 |
| 4,773,878 | 9/1988 | Hansell, III | 439/497 |
| 4,787,860 | 11/1988 | Bender | 439/358 |
| 4,936,793 | 6/1990 | Uchida | 439/357 |
| 5,007,856 | 4/1991 | Puerner | 439/452 |
| 5,021,002 | 6/1991 | Noschese | 439/352 |
| 5,044,994 | 9/1991 | Van Woensel | 439/681 |
| 5,088,932 | 2/1992 | Nakamura | 439/610 |
| 5,104,334 | 4/1992 | Honma et al. | 439/357 |
| 5,158,473 | 10/1992 | Takahashi et al. | 439/489 |
| 5,197,901 | 3/1993 | Hashiguchi | 439/357 |

FOREIGN PATENT DOCUMENTS 3222683 6/1981 Germany .

OTHER PUBLICATIONS

Burndy Corporation Product Catalog, pp. 5–38:5–43, "The Connector Selector" Master Catalog, vol. 2, 1986.

*Primary Examiner*—Gary F. Paumen
*Assistant Examiner*—Hien D. Vu
*Attorney, Agent, or Firm*—Perman & Green

[57] ABSTRACT

An electrical connector having a housing, quick release latches, and a hood. The hood allows an electrical cable to exit the hood in three different directions. The quick release latches are located on opposite ends of the housing and allow the connector to be easily snap-lock connected to a second connector and easily released from the second connector by depressing the latches. The use of the hood, the size and shape of the housing, and the simplicity of the latches combine to provide a lightweight connector that can be used in aircrafts for entertainment systems.

16 Claims, 3 Drawing Sheets

LIGHTWEIGHT ENTERTAINMENT CONNECTOR

BACKGROUND OF THE INVENTION

1. Field of the Invention

The present invention relates to electrical connectors and, more particularly, to a lightweight connector having disconnect latches.

2. Prior Art

U.S. Pat. No. 4,602,838 discloses an electronic key assembly having a body with latch arms that extend outwardly and rearwardly from sides of the body. U.S. Pat. No. 4,936,793 discloses pivotably connected locking pieces on a connector. U.S. Pat. No. 4,718,857 discloses edge latches with notches that engage ends of fingers on two connectors. Connectors such as the Mixed PI 42 plug manufactured by Burndy Corporation, Norwalk, Connecticut, have signal contacts and positions for removable RF coaxial and/or power contacts. U.S. Pat. Nos. 4,764,129 and 5,044,994 disclose keys or keying sections for connectors. U.S. Pat. Nos. 3,569,900; 4,715,827; 5,007,856; and 4,421,376 disclose connector housing pieces that are connected to each other. The following patents show background technology in the connector art: U.S. Pat. Nos. 4,787,860; 4,682,828; 4,773,878; 3,149,897; 3,409,859; 5,021,002; 3,569,903; 5,104,334; and German patent publication DE 3222 683 A1.

SUMMARY OF THE INVENTION

In accordance with one embodiment of the present invention an electrical connection system is provided comprising a first electrical connector and a second electrical connector. The first electrical connector has a first housing, a plurality of first contacts, and latch hooks.

The first housing has a receiving area with the latch hooks located at opposite ends of the receiving area. The second electrical connector is removably matingly connected to the first electrical connector in the receiving area. The second electrical connector has a second housing, a plurality of second contacts and deflectable latches at opposite ends of the second housing. The latches each have a hole with the latch hooks located therein and are inwardly deflectable towards the second housing to remove the latch from engagement with its latch hook.

In accordance with another embodiment of the present invention an electrical connector and cable assembly is provided comprising an electrical cable having a plurality of electrical conductors, a plurality of contacts connected to first ends of the conductors, a housing surrounding the contacts and having hood interlock sections, and a hood fixedly connected to the housing. The hood has two half sections fixedly connected to each other sandwiching a rear end of the housing and having housing interlock sections connected to the hood interlock sections. The hood further comprises a hole with the cable extending therethrough.

BRIEF DESCRIPTION OF THE DRAWINGS

The foregoing aspects and other features of the invention are explained in the following description, taken in connection with the accompanying drawings, wherein.

DETAILED DESCRIPTION OF THE INVENTION

Figure 1:
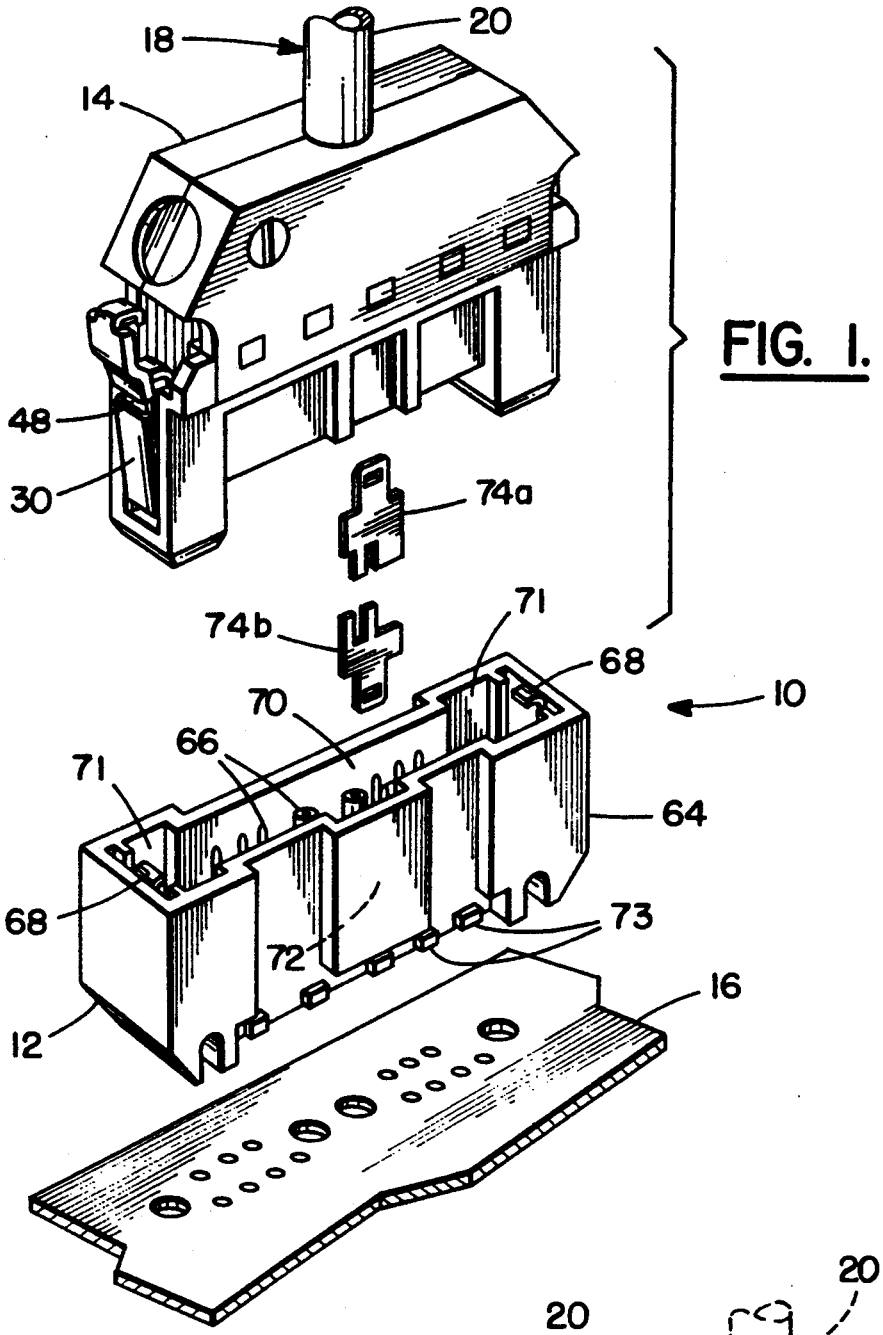
FIG. 1 is an exploded perspective view of an electrical connection system comprising features of the present invention.

Referring to FIG. 1, there is shown an electrical connection system 10 incorporating features of the present invention. Although the present invention will be described with reference to the embodiments shown in the drawings, it should be understood that the present invention can be embodied in various different types and kinds of alternate embodiments. In addition, any suitable size, shape, and type of elements, members or materials could be used.

The system 10 generally comprises a first electrical connector 12 and a second electrical connector 14. In the embodiment shown, the first electrical connector 12 is adapted to be electrically and mechanically connected to a printed circuit board 16. The first connector 12 can be mounted perpendicular to the board 16 as illustrated in FIG. 1 or parallel, and can have it's contacts through-hole or surface mounted. In an alternate embodiment, the first connector 12 could be part of a connector and cable assembly. The second electrical connector 14 is adapted to be electrically and mechanically removably connected to the first connector 12. In the embodiment shown the second connector 14 is part of an electrical connector and cable assembly 18 having an electrical cable 20 with individual conductors 22 (see FIG. 2). The system 10 has been particularly developed for its lightweight design, adaptability, and versatility. This makes the system particularly useful for use in aircrafts as a connector system for use in an entertainment system of the aircraft. Unlike the old entertainment systems used in aircrafts, new proposed entertainment systems are being designed to provide individual and separate audio and video outputs to each seat. One such system is described in FIG. 11 of U.S. Pat. No. 5,034,807 to Von Kohorn. Systems that may be integrated into such entertainment systems may include telephone communications, television reception, radio reception, video games, movies, and computer power and communications hook-ups for personal laptop computers. The present invention is for connecting such individual and separate console/display/control units to a main entertainment control center(s) of the aircraft.

Figure 3:
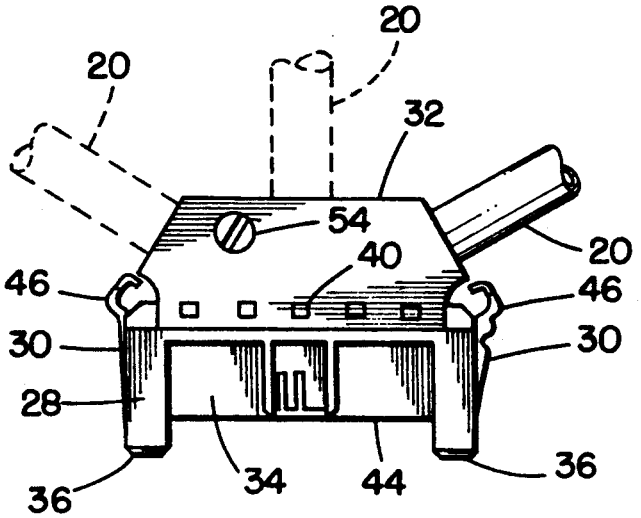
FIG. 3 is a side view of the connector and cable assembly shown in FIG. 2.
Figure 2:
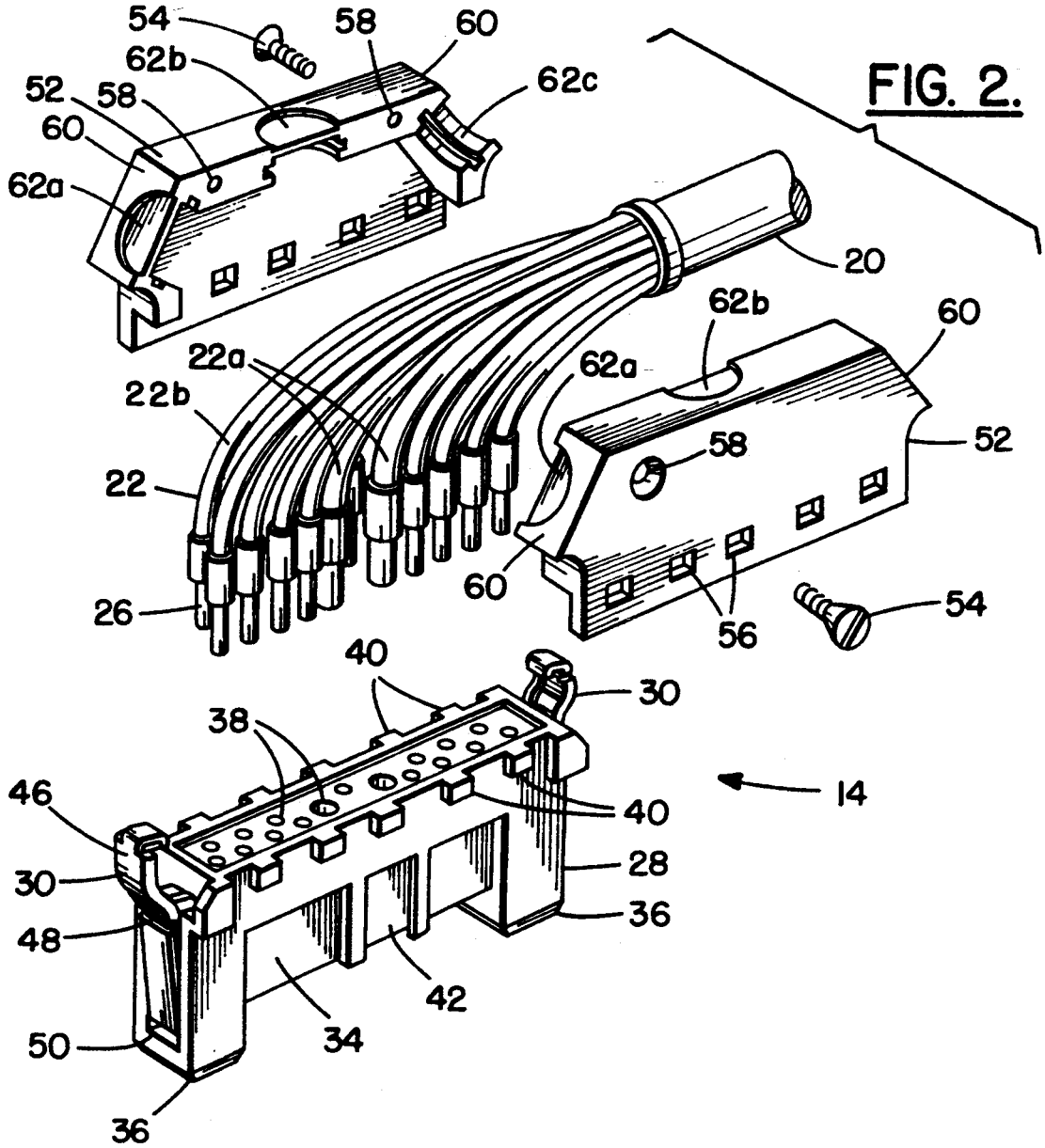
FIG. 2 is an exploded perspective view of one end of the connector and cable assembly shown in the system of FIG. 1.
Figure 4:
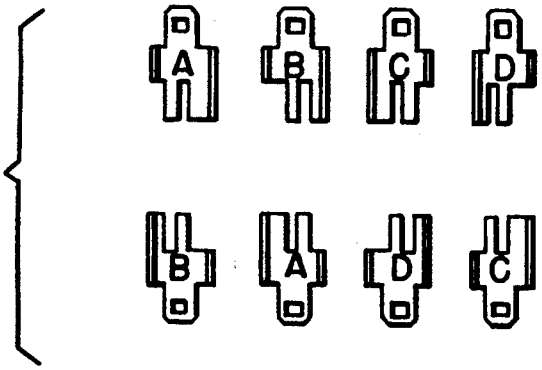
FIG. 4 is a plan top view of various different grouping of discrimination keys used in the system shown in FIG. 1.

Referring to FIGS. 1–3, the cable 20, in the embodiment shown, has a plurality of conductors 22. First ends 24 have female contacts 26 and second ends (not shown) are either connected to the main entertainment control center or to another connector (not shown) for connection to an adjacent or proximate seat console/display/control unit. In the embodiment shown, the conductors 22 include two coaxial conductors **22*a*** and fifteen other wire conductors 22*b*. However, any suitable number or type of conductors or contacts could be provided and, the contacts 26 could be male or a combination of male and female.

The second connector 14 includes a housing 28, two latches 30, and a hood 32. The housing 28 is comprised of a dielectric material such as a molded plastic or polymer material. The housing 28 has a center section 34 and two enlarged end sections 36. The center section 34 has contact receiving and mounting holes 38 for fixedly receiving and mounting the contacts 26. The exterior of the center section 34 also includes hood interlock sections 40 along its sides at its top, and a key receiving area 42 along one of its sides. The end sections 36 are generally wider than the center section 34 and extend past a bottom leading face 44 of the center section. The end sections 36 have cavities with the latches 30 located therein. The latches 30 can be made of metal or deflectable plastic and each includes a finger contact area 46, a latch hole 48, and a front end 50. The front ends 50 are substantially stationarily located at the front of the housing, but being able to deform to allow the finger contact areas 46 to be moved or deflected inward towards the housing 28. The latches 30 function as snap-lock quick release latches for mechanical connection to the first connector 12. The hood 32 is generally comprised of two half sections 52 and two screws 54. The half sections 52 are preferably made of molded plastic or polymer and are substantially mirror images of each other. The half sections 52 each comprise housing interlock sections 56, screw holes 58, angled top sides 60, and three areas 62*a*, 62*b*, 62*c* for allowing the cable 20 to pass through the hood 32. The two half sections 52 are connected to each other by the screws 54. The bottom of the half sections 52 sandwich the top of the center section 34 with the hood interlock sections 40 being received in the apertures of the housing interlock sections 56. This engagement of the half sections to each other and with the housing effectively locks the hood 32 on the housing 28. The hood 32 establishes an enclosed cavity over the top of the housing 28. This enclosed cavity allows the conductors 22 to be freely distributed to their respective holes 38. In order to allow the cable 20 to exit the hood 32, the three areas 62*a*, 62*b*, 62*c* are provided. When initially manufactured the half sections 52 have knock-out sections in all three of the areas 62*a*, 62*b*, 62*c*. During assembly, one of these knock-out sections 64 is removed for each half section. Due to the location of the areas 62*a*, 62*b*, 62*c* and the angled top sides 60, this allows the cable 20 to exit the hood 32 in three different orientations as illustrated in FIG. 3. This variable configuration of cable exit is particularly useful for an aircraft entertainment connector when the cable 20 needs to be directed to the right, left, straight back or down from the passenger's seat to a main cable located along or behind the side or floor of the aircraft or to an adjacent seat. The remaining knock-outs are left in place to keep the cavity inside the hood enclosed. The cable 20 is sandwiched at the opened area by the half sections to form a strain relief.

Referring primarily to FIG. 1, the first electrical connector 12 generally comprises a housing 64, electrical contacts 66, and latch hooks 68. The housing 64 is made of a dielectric material such as a molded plastic or polymer material. The housing 64 includes a receiving area 70 for receiving the bottom of the second connector 14 therein. The receiving area 70 is suitably sized and shaped to matingly receive the bottom half of the second connector 14 and, for this purpose, has enlarged and deeper end areas 71. The housing 64 also includes a key receiving area 72 at an interior of one of its sides. The latch hooks 68 are located in the receiving area 70; one at each end of the two enlarged end areas 71. The latch hooks can be integrally formed with the housing 64. However, in the embodiment shown, the latch hooks 68 comprise metal members that are fixedly connected to the housing 64. The electrical contacts 66 are attached to the housing 64 and have first end suitably configured to make electrical contact with the second electrical contacts 26 of the second connector 14. Opposite second ends (not shown) of the contacts 66 are adapted to make electrical contact with the printed circuit board 16. The first connector 12 is shown in FIG. 1 as having its bottom mounted against the printed circuit board 16. However, the first connector 12 could also be mounted on its side to the board 16 by use of the contacts having right angled second ends and an adaptor (not shown) that would attach to extensions 73.

The two connectors 12, 14 also each comprise registration keys 74*a*, 74*b*. The keys 74*a*, 74*b* are snap lock mounted to the housings 28, 64 to prevent connectors that do not have matching contact configurations from being connected to each other. In an alternate embodiment, the registration feature of the keys could be integrally molded into the housings 28, 64.

As the two connectors 12, 14 are being connected to each other, the latch hooks 68 bear against the latches 30 and deflect the latches 30 inward. When the latch holes 48 come into registration with the latch hooks 68, the latches 30 are able to spring outward capturing the latch hooks 68 in the holes 48. This snap-locks the two connectors to each other. The unique shape of the enlarged end sections 36 of the second connector 14 and enlarged end areas 71 of the receiving area 70 combine to provide a stable interlocking mechanical connection between the two connectors. This is especially important in the high vibration environment of an aircraft. The design prevents vibrations from interfering with signal or power transmissions between the contacts 26, 66. In order to disconnect the second connector 14 from the first connector 12, a user merely pinches or pushes the two finger contact sections 46 towards the housing 28. This removes the locking engagement between the latches 30 and the latch hooks 68. The user then merely pulls the second connector 14 out of the first connector 12.

Figure 5:
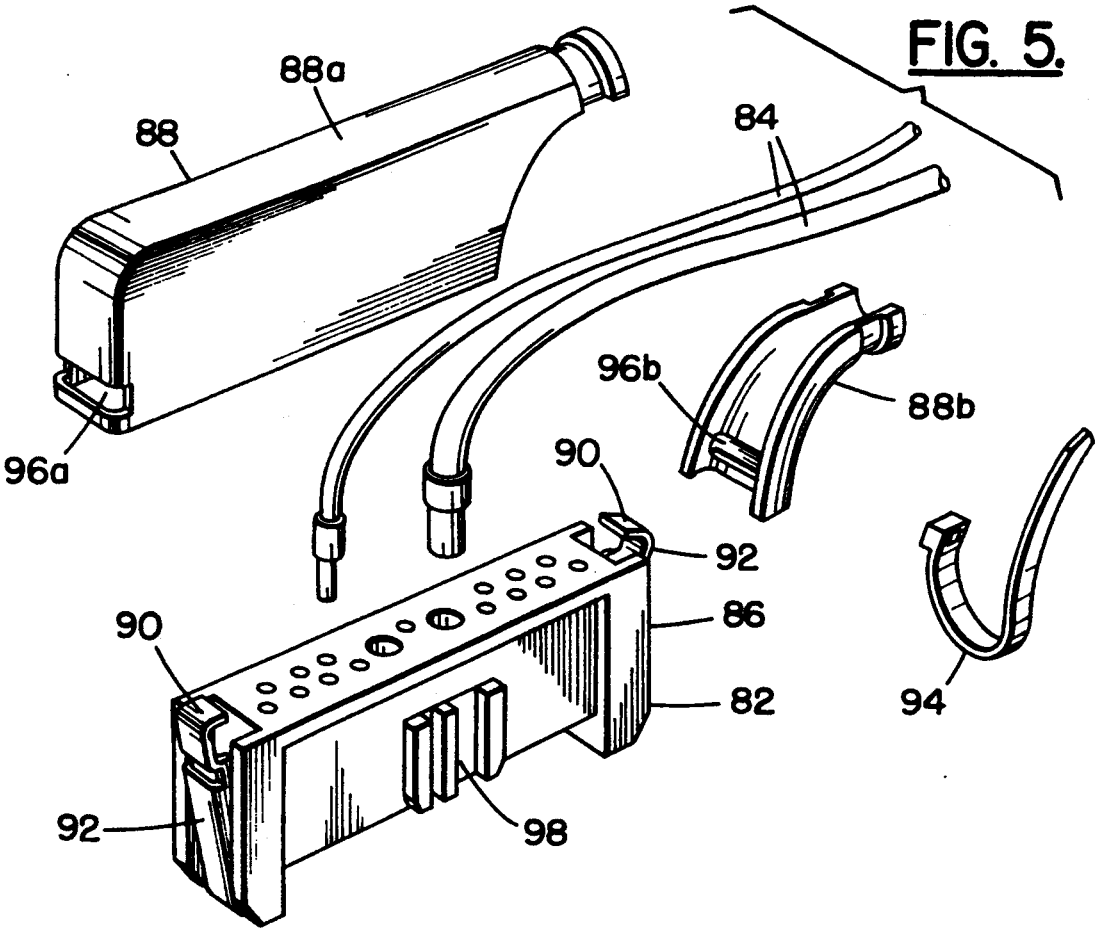
FIG. 5 is an exploded perspective view of an alternate form of connector similar to the connector shown in FIGS. 2 and 3.
Figure 6:
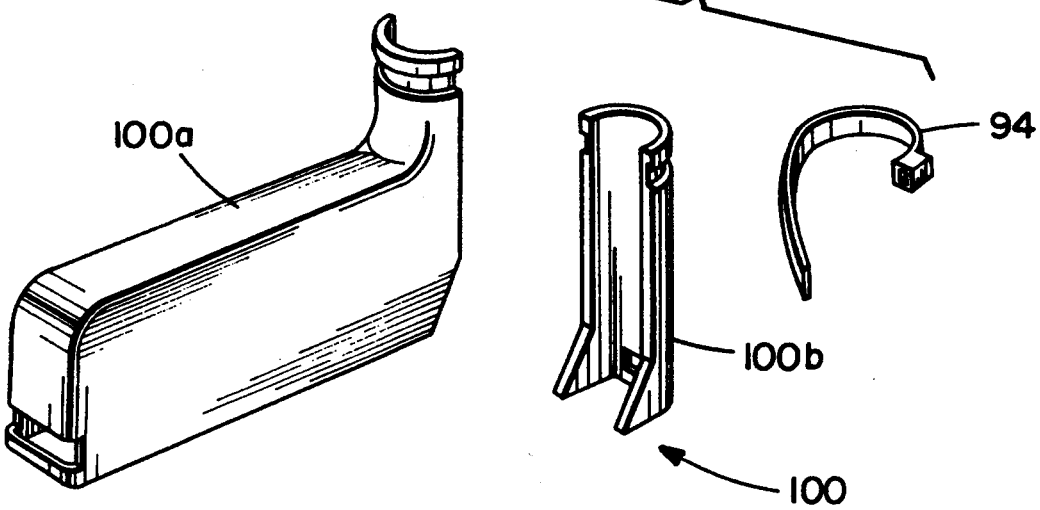
FIG. 6 is an exploded perspective view of an alternate form of connector hood from that shown in FIG. 5.

Referring now to FIG. 5, an exploded perspective view of an alternate embodiment of a cable assembly is shown. The cable assembly has a second connector 82 and an electrical cable with conductors 84. The connector 82 has a housing 86 similar to the housing 28 shown in FIG. 2. However, in the embodiment shown, the housing 86 does not have hood locking sections. Rather, the hood 88 is retained by hood locking sections 90 on the latches 92. The hood 88 is comprised of two members 88*a*, 88*b* and a cable tie 94. The two members 88*a*, 88*b* each comprise a notch 96*a*, 96*b*. The members 88*a*, 88*b* are located on the top of the housing 86 with the hood locking sections 90 extending into the notches 96*a*, 96*b* and the cable tie 94 is connected to keep the two members 88*a*, 88*b* together. The housing 86 also has an integral discrimination section 98. The hood 88 can be attached in two orientations to provide cable exit at either end of the connector 82. FIG. 6 is a perspective exploded view of an alternate form of hood similar to the hood 88 shown in FIG. 5. In the embodiment shown, the hood 100 includes two members 100*a*, 100*b* and a cable tie 94. The primary difference from the embodiment shown in FIG. 5 is the fact that the hood 100 is adapted to exit the cable from the back of the connector rather than to its side. In alternate embodiments other types of hoods could be provided.

It should be understood that the foregoing description is only illustrate of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. An electrical connection system comprising:

a first electrical connector having a first housing, a plurality of first contacts, and latch hooks, the first housing having a receiving area with the latch hooks located inside of the receiving area and facing each other from opposite ends of the receiving area; and a second electrical connector removably matingly connected to the first electrical connector in the receiving area, the second electrical connector having a second housing, a plurality of second contacts, and deflectable latches at opposite ends of the second housing, the latches each having a section with a hole, the latch hooks being located in respective ones of the holes, wherein the sections of the latches having the holes are inwardly deflectable towards the second housing to remove each of the latches from engagement with its respective latch hook, and wherein the housing has a center section and two enlarged end sections, the end sections extending past a leading face of the center section.

2. A system as in claim 1 wherein the second electrical connector includes a hood connected to a rear end of the second housing, the hood having two half sections that are connected to each other and sandwich a portion of the second housing therebetween, the hood and second housing having interlocking sections to prevent the hood form being inadvertently removed from the second housing.

3. A system as in claim 2 wherein the interlocking sections comprise the hood having holes therein and the second housing having projections that project into the holes.

4. A system as in claim 2 wherein the hood includes means to allow an electrical cable to exit the hood in three different directions.

5. A system as in claim 1 wherein the first and second electrical connectors each include registration keys connected to the first and second housings that matingly engage each other.

6. A system as in claim 5 wherein the registration keys are snap-lock connected to the housings.

7. A system as in claim 1 wherein the second contacts include coaxial female contacts and a plurality of pin receiving contacts.

8. A system as in claim 1 wherein the latches have finger contact areas located above the first housing.

9. An electrical connector and cable assembly comprising:

an electrical cable having a plurality of electrical conductors;

a plurality of contacts connected to first ends of the conductors;

a housing surrounding the contacts and having hood interlock sections; and a hood fixedly connected to the housing, the hood having two half sections fixedly connected to each other sandwiching a rear end of the housing and having housing interlock sections connected to the hood interlock sections, the hood further comprising a hole with the cable extending therethrough, wherein the hood sandwiches only the rear end of the housing, the rest of the housing being located in front of the hood, the hood interlock sections being located along the rear end of the housing and the housing interlock sections being located along a front end of the hood, and wherein the housing has a center section and two enlarged end sections, the end sections extending past a leading face of the center section.

10. An assembly as in claim 9 wherein the hood interlock sections comprise projections extending from the housing and the housing interlock sections comprise holes in the hood.

11. An assembly as in claim 9 wherein the hood has means to allow the cable to extend from the hood in three different directions.

12. An assembly as in claim 9 wherein the housing includes a registration key snap-locked onto the housing.

13. An assembly as in claim 9 wherein the contacts include two coaxial female contacts and a plurality of pin receiving contacts.

14. An assembly as in claim 9 further comprising quick release latches on opposite ends of the housing that are deflectable towards the housing, the latches having substantially stationary front ends proximate a front of the housing and outwardly extended deflectable rear ends proximate a rear end of the housing.

15. An assembly as in claim 14 wherein the rear ends of the latches have holes for being engaged by latch hooks on a mating electrical connector.

16. An assembly as in claim 15 wherein the rear ends of the latches are inwardly deflectable towards the housing.

* * * * *